US010665159B2

(12) United States Patent
Wang et al.

(10) Patent No.: US 10,665,159 B2
(45) Date of Patent: May 26, 2020

(54) PIXEL COMPENSATING CIRCUIT AND PIXEL COMPENSATING METHOD

(71) Applicant: Wuhan China Star Optoelectronics Semiconductor Display Technology Co., Ltd., Wuhan, Hubei (CN)

(72) Inventors: Yiyi Wang, Hubei (CN); Shaobo Wang, Hubei (CN)

(73) Assignee: WUHAN CHINA STAR OPTOELECTRONICS SSEMICONDUCTOR DISPLAY TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 16/234,187

(22) Filed: Dec. 27, 2018

(65) Prior Publication Data

US 2019/0325818 A1 Oct. 24, 2019

Related U.S. Application Data

(63) Continuation of application No. PCT/CN2018/089413, filed on May 31, 2018.

(30) Foreign Application Priority Data

Apr. 18, 2018 (CN) ..... 2018 1 0350263

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2320/0626* (2013.01)

(58) Field of Classification Search
CPC ..... G09G 3/3266; G09G 3/3225; G09G 2320/0626
See application file for complete search history.

(56) References Cited

U.S. PATENT DOCUMENTS

2019/0172395 A1* 6/2019 Yuan ..... G09G 3/3233
2019/0295476 A1* 9/2019 Ji ..... G09G 3/32

FOREIGN PATENT DOCUMENTS

CN 106652903 A 5/2017

* cited by examiner

*Primary Examiner* — Kwang-Su Yang
(74) *Attorney, Agent, or Firm* — Leong C. Lei

(57) ABSTRACT

In the compensating circuit, a second thin film transistor (TFT) are connected to a gate and drain of a first TFT, and a source of the first TFT receives a constant DC voltage signal, and the second TFT receives a scan signal of nth stage; a third TFT is connected to the drain of the first TFT, is connected to a common ground through a light emitting device, and receives an enable signal; a fourth TFT receives a scan signal of n−1th stage, and is connected to a first end of a storage capacitor and the gate of the TFT, and a second end of the storage capacitor is connected to a fifth TFT and a sixth TFT; the fifth TFT receives a data signal and the scan signal of nth stage, respectively; the sixth TFT is connected to the common ground and receives the enable signal, respectively.

10 Claims, 2 Drawing Sheets

PIXEL COMPENSATING CIRCUIT AND PIXEL COMPENSATING METHOD

CROSS-REFERENCE TO RELATED APPLICATION

This application is a continuing application of PCT Patent Application No. PCT/CN2018/089413 entitled "Pixel compensating circuit and pixel compensating method", filed on May 31, 2018, which claims priority to Chinese Patent Application No. 201810350263.3, filed on Apr. 18, 2018, both of which are hereby incorporated in its entireties by reference.

FIELD OF THE INVENTION

The present invention relates to a display technology field, and more particularly to a pixel compensating circuit and a pixel compensating method.

BACKGROUND OF THE INVENTION

In the display area of the AMOLED (Active-matrix organic light emitting diode) display device, the pixels are arranged in an array comprising multiple rows, multiple columns. Each pixel generally utilizes a pixel circuit comprising two thin film transistors and one capacitor for performing driving, i.e. the 2T1C driving. This 2T1C design is sensitive to the following factors: threshold voltage (Vth) and channel mobility of thin film transistor (TFT), starting voltage and quantum efficiency of OLED (organic light emitting diode) and transient process of power supply. These factors can result in uneven brightness when different OLEDs emit light. Therefore, it is generally necessary to use a compensating circuit to reduce the influence of these factors. For example, 7T1C circuit composed of seven thin film transistors and one capacitor and 6T2C circuit composed of six thin film transistors and two capacitors.

SUMMARY OF THE INVENTION

For solving the aforesaid technical issues, the present invention provides a pixel compensating circuit and a pixel compensating method, which can reduce the influence of the threshold voltage of the thin film transistor on the light emitting device, so that the brightness of the emitting light of the light emitting device is more uniform.

The present invention provides a pixel compensating circuit, comprising:

a first thin film transistor, wherein a source of the first thin film transistor receives a constant direct current voltage signal;

a second thin film transistor, wherein a first end of the second thin film transistor is connected to a gate of the first thin film transistor, and a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, and a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of n−1th stage;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, and a second end of the fifth thin film transistor receives a data signal, and a third end of the fifth thin film transistor receives the scan signal of nth stage;

a sixth thin film transistor, wherein a first end of the sixth thin film transistor is connected to the second end of the storage capacitor, and a second end of the sixth thin film transistor is connected to the common ground, and a third end of the sixth thin film transistor receives the enable signal;

on and off of the second thin film transistor and the fifth thin film transistor is controlled with the scan signal of nth stage, and on and off of fourth thin film transistor is controlled with the scan signal of n−1th stage, and on and off of the third thin film transistor and the sixth thin film transistor is controlled with the enable signal.

Preferably, the first thin film transistor, the second thin film transistor, the third thin film transistor, the fourth thin film transistor, the fifth thin film transistor and the sixth thin film transistor are all P-type thin film transistors.

Preferably, the light emitting device is an organic light emitting diode device.

Preferably, as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

The present invention further provides a pixel compensating method, applied in a pixel compensating circuit, wherein the pixel compensating circuit comprises:

a first thin film transistor, wherein a source of the first thin film transistor receives a constant direct current voltage signal;

a second thin film transistor, wherein a first end of the second thin film transistor is connected to a gate of the first thin film transistor, and a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, and a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of n−1th stage;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, and a second end of the fifth thin film transistor receives a data signal, and a third end of the fifth thin film transistor receives the scan signal of nth stage;

a sixth thin film transistor, wherein a first end of the sixth thin film transistor is connected to the second end of the storage capacitor, and a second end of the sixth thin film transistor is connected to the common ground, and a third end of the sixth thin film transistor receives the enable signal;

wherein the pixel compensating method comprises:

S1, turning on the fourth thin film transistor to clear a charge of the storage capacitor;

S2, turning on the second thin film transistor to pull a gate potential of the first thin film transistor and the first end of the storage capacitor to a first potential value, and turning on the fifth thin film transistor to pull a potential of the second end of the storage capacitor to a second potential value, wherein the first potential value is Vdd−|Vth1|, and the second potential value is Vdata, and Vdd is a voltage value of the constant direct current voltage signal received by the source of the first thin film transistor, and Vth1 is a threshold voltage of the first thin film transistor, and Vdata is a voltage value of the data signal received by the fifth thin film transistor;

S3, turning on the sixth thin film transistor to pull a potential of the gate of the first thin film transistor to a third potential value to control the first thin film transistor to be on, and turning on the third thin film transistor to drive the light emitting device to emit light, wherein the third potential value is Vdd−|Vth1|−Vdata.

Preferably, the fourth thin film transistor is turned on with the scan signal of n−1th stage, and the second thin film transistor and the fifth thin film transistor are turned on with the scan signal of nth stage, and the third thin film transistor and the sixth thin film transistor are turned on with the enable signal.

Preferably, as the fourth thin film transistor is turned on with the scan signal of n−1th stage, the scan signal of n−1th stage is a low potential signal;

as the second thin film transistor and the fifth thin film transistor are turned on with the scan signal of nth stage, the scan signal of nth stage is a low potential signal;

as the third thin film transistor and the sixth thin film transistor are turned on with the enable signal, the enable signal is a low potential signal.

Preferably, as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

The present invention further provides a pixel compensating method, applied in a pixel compensating circuit, wherein the pixel compensating circuit comprises:

a first thin film transistor, wherein a source of the first thin film transistor receives a constant direct current voltage signal;

a second thin film transistor, wherein a first end of the second thin film transistor is connected to a gate of the first thin film transistor, and a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, and a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of n−1th stage;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, and a second end of the fifth thin film transistor receives a data signal, and a third end of the fifth thin film transistor receives the scan signal of nth stage;

a sixth thin film transistor, wherein a first end of the sixth thin film transistor is connected to the second end of the storage capacitor, and a second end of the sixth thin film transistor is connected to the common ground, and a third end of the sixth thin film transistor receives the enable signal;

wherein the pixel compensating method comprises:

S1, turning on the fourth thin film transistor to clear a charge of the storage capacitor;

S2, turning on the second thin film transistor to pull a gate potential of the first thin film transistor and the first end of the storage capacitor to a first potential value, and turning on the fifth thin film transistor to pull a potential of the second end of the storage capacitor to a second potential value, wherein the first potential value is Vdd−|Vth1|, and the second potential value is Vdata, and Vdd is a voltage value of the constant direct current voltage signal received by the source of the first thin film transistor, and Vth1 is a threshold voltage of the first thin film transistor, and Vdata is a voltage value of the data signal received by the fifth thin film transistor;

S3, turning on the sixth thin film transistor to pull a potential of the gate of the first thin film transistor to a third potential value to control the first thin film transistor to be on, and turning on the third thin film transistor to drive the light emitting device to emit light, wherein the third potential value is Vdd−|Vth1|−Vdata;

wherein the fourth thin film transistor is turned on with the scan signal of n−1th stage, and the second thin film transistor and the fifth thin film transistor are turned on with the scan signal of nth stage, and the third thin film transistor and the sixth thin film transistor are turned on with the enable signal;

as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

Preferably, as the fourth thin film transistor is turned on with the scan signal of n−1th stage, the scan signal of n−1th stage is a low potential signal;

as the second thin film transistor and the fifth thin film transistor are turned on with the scan signal of nth stage, the scan signal of nth stage is a low potential signal;

as the third thin film transistor and the sixth thin film transistor are turned on with the enable signal, the enable signal is a low potential signal.

The implementation of the present invention possesses the following benefits: since the threshold voltage of the first thin film transistor is prone to drift, the magnitude of the currents flowing through different light emitting devices are different, thereby causing luminance unevenness when the light emitting device emits light. In the pixel compensating circuit of the present invention, the threshold voltage of the first thin film transistor can be compensated by the second thin film transistor. When the light emitting device emits light, the magnitude of the current flowing through the light emitting device is independent of the threshold voltage of the first thin film transistor, and the influence of factors such as the electron and hole transport efficiency in the light emitting device and the quantum efficiency of the light emitting device is reduced. Therefore, in the present invention, the influence of the first thin film transistor on the light emitting device can be neglected, so that the brightness of the different light emitting devices when emitting light is uniform.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 1:
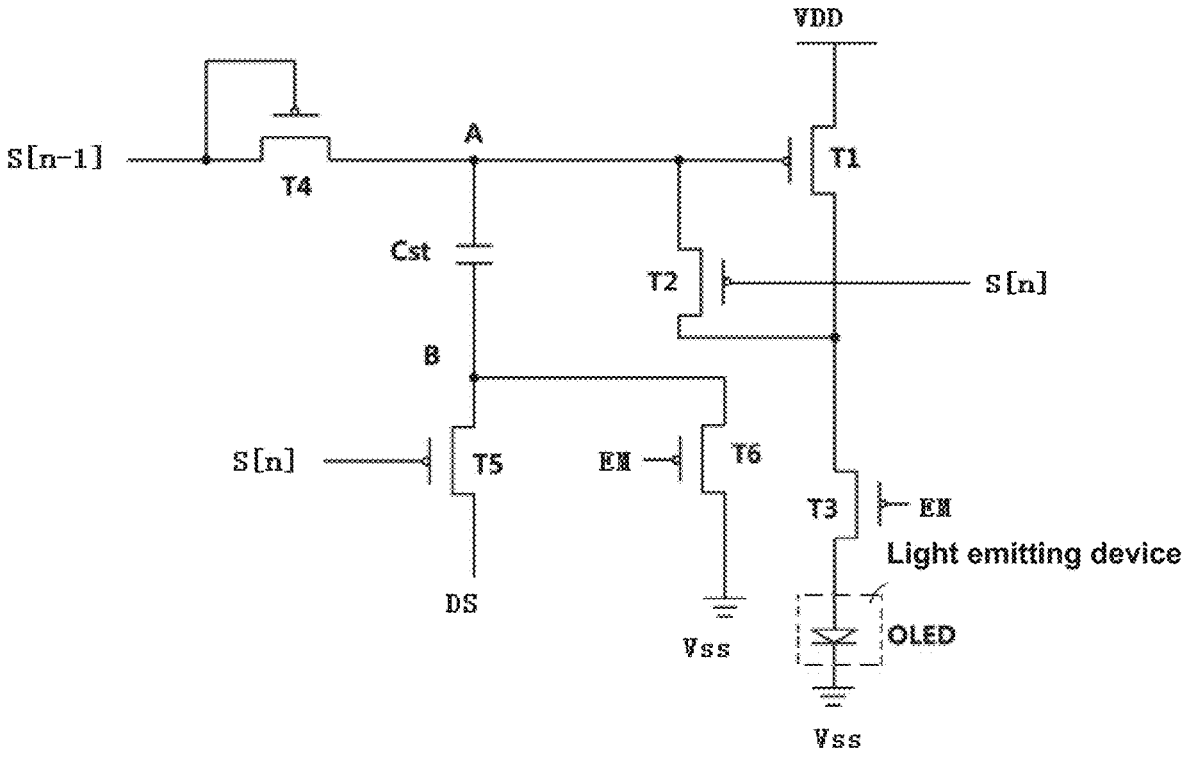
FIG. 1 is a circuit diagram of a pixel compensating circuit according to the present invention.

The present invention provides a pixel compensating circuit, as shown in FIG. 1, comprising a first thin film transistor T1, a second thin film transistor T2, a third thin film transistor T3, a fourth thin film transistor T4, a fifth thin film transistor T5, a sixth thin film transistor T6 and a light emitting device. Generally, the storage capacitor Cst comprises a pixel electrode and a common electrode line.

A source of the first thin film transistor T1 is connected to the constant direct current voltage signal VDD.

A first end of the second thin film transistor T2 is connected to a gate of the first thin film transistor T1, and a second end of the second thin film transistor T2 is connected to a drain of the first thin film transistor T1, and a third end of the second thin film transistor T2 receives a scan signal of nth stage S[n], n>1 outputted by a GOA unit of nth stage in a GOA (Gate Driver on Array) circuit.

A first end of the third thin film transistor T3 is connected to a drain of the first thin film transistor T1, and a second end of the third thin film transistor T3 is connected to a common ground Vss through a light emitting device, and a third end of the third thin film transistor T3 receives an enable signal EM.

A first end and a third end of the fourth thin film transistor T4 receives a scan signal of n−1th stage S[n−1] outputted by a GOA unit of n−1th stage in the GOA circuit.

A first end of the storage capacitor Cst is connected to the gate of the first thin film transistor T1 and to the second end of the fourth thin film transistor T4 at a node A.

A first end of the fifth thin film transistor T5 is connected to a second end of the storage capacitor Cst, at a node B and a second end of the fifth thin film transistor T5 receives a data signal DS, and a third end of the fifth thin film transistor T5 receives the scan signal of nth stage S[n].

A first end of the sixth thin film transistor T6 is connected to the second end of the storage capacitor Cst at the node B, and a second end of the sixth thin film transistor T6 is connected to the common ground Vss, and a third end of the sixth thin film transistor T6 receives the enable signal EM.

On and off of the second thin film transistor T2 and the fifth thin film transistor T5 is controlled with the scan signal of nth stage S[n], and on and off of fourth thin film transistor T4 is controlled with the scan signal of n−1th stage S[n−1], and on and off of the third thin film transistor T3 and the sixth thin film transistor T6 is controlled with the enable signal EM. The first end of the thin film transistor is one of a source and a drain, the second end of the thin film transistor is the other of the source and the drain, and the third end of the thin film transistor is a gate. When both the first thin film transistor T1 and the third thin film transistor T3 are turned on, the light emitting device starts operating.

Furthermore, the first thin film transistor T1, the second thin film transistor T2, the third thin film transistor T3, the fourth thin film transistor T4, the fifth thin film transistor T5 and the sixth thin film transistor T6 are all P-type thin film transistors.

Furthermore, the light emitting (OLED) device is an organic light emitting diode device. The positive electrode of the OLED device is connected to the drain of the first thin film transistor T1, and the negative electrode of the OLED device is connected to the common ground terminal Vss.

Furthermore, as the light emitting device operates, a current through the light emitting device is calculated from a hole mobility of the first thin film transistor T1, a capacitance of a gate insulating layer per unit area in the first thin film transistor T1, a channel width and a channel length of the first thin film transistor T1, and a voltage value of the data signal.

The current through the light emitting device is Id, and the Id satisfies:

$$Id = \frac{1}{2}\mu_p C_{ox}\frac{W}{L}(V_{sg} + V_{th1})^2;$$

meanwhile:

$$Id = \frac{1}{2}\mu_p C_{ox}\frac{W}{L}[V_{dd} - (V_{dd} - |Vth1| - Vdata) + Vth1]^2;$$

and meanwhile:

$$Id = \frac{1}{2}\mu_p C_{ox}\frac{W}{L}(V_{data})^2;$$

accordingly, the final result of Id is not related to the threshold voltage of the first thin film transistor T1.

μp is the hole mobility (also referred to as channel mobility) of the first thin film transistor T1. Cox is the capacitance of the gate insulating layer per unit area in the first thin film transistor T1. W is the channel width of the first thin film transistor T1, and L is the channel length of the first thin film transistor T1. Vdata is the voltage value of the data signal DS. Vsg is the voltage between the source and the gate of the first thin film transistor T1. Vth1 is the threshold voltage of the first thin film transistor T1. Vdd is the voltage value of the constant direct current voltage signal VDD received by the first thin film transistor T1.

The present invention further provides a pixel compensating method, applied in the aforesaid pixel compensating circuit. The pixel compensating circuit comprises:

S1, turning on the fourth thin film transistor T4 to clear a charge of the storage capacitor Cst; in general, the charge of the storage capacitor Cst can be conducted to the GOA unit of n−1th stage connected to the fourth thin film transistor T4.

S2, turning on the second thin film transistor T2 to pull a gate potential of the first thin film transistor T1 and the first end of the storage capacitor Cst (i.e. the potential of node A) to a first potential value, and turning on the fifth thin film transistor T5 to pull a potential of the second end of the storage capacitor Cst to a second potential value, wherein the first potential value is Vdd−|Vth1|, and the second potential value is Vdata, and Vdd is a voltage value of the constant direct current voltage signal VDD received by the source of the first thin film transistor T1, and Vth1 is a threshold voltage of the first thin film transistor T1, and Vdata is a voltage value of the data signal DS received by the fifth thin film transistor T5.

S3, turning on the sixth thin film transistor T6 so that the gate and the drain of the first thin film transistor T1 are short-circuited, and the first thin film transistor T1 is equivalent to a diode, to pull a potential of the gate of the first thin film transistor T1 to a third potential value to control the first thin film transistor T1 to be on, and turning on the third thin film transistor T3 to drive the light emitting device to emit light. The third potential value is Vdd−|Vth1|−Vdata.

Furthermore, the fourth thin film transistor T4 is turned on with the scan signal of n−1th stage S[n−1], and the second thin film transistor T2 and the fifth thin film transistor T5 are turned on with the scan signal of nth stage S[n], and the third thin film transistor T3 and the sixth thin film transistor T6 are turned on with the enable signal EM.

Furthermore, as the fourth thin film transistor T4 is turned on with the scan signal of n−1th stage S[n−1], the scan signal of n−1th stage S[n−1] is a low potential signal.

As the second thin film transistor T2 and the fifth thin film transistor T5 are turned on with the scan signal of nth stage S[n], the scan signal of nth stage S[n] is a low potential signal.

As the third thin film transistor T3 and the sixth thin film transistor T6 are turned on with the enable signal EM, the enable signal EM is a low potential signal.

Figure 2:
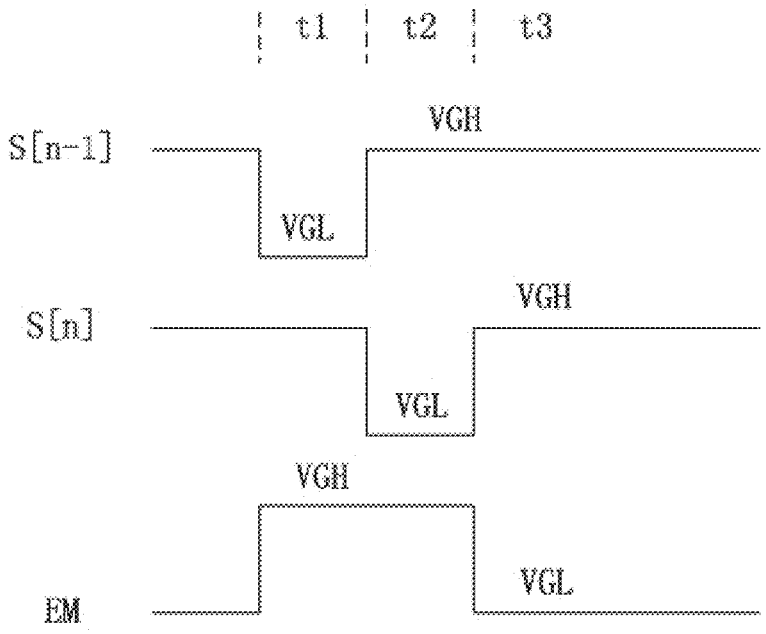
FIG. 2 is a signal timing diagram of a pixel compensating circuit according to the present invention.

Steps S1, S2 and S3 respectively correspond to the t1 period, the t2 period and the t3 period in FIG. 2. In the t1 period, the scan signal of n−1th stage S[n−1] is at the low potential VGL, and the scan signal of nth stage S[n] and the enable signal EM are at the high potential VGH. In the t2 period, the scan signal of n−1th stage S[n−1] and the enable signal EM are at the high potential VGH, and the scan signal of nth stage S[n] is at the low potential VGL. In the t3 period, the scan signal of n−1th stage S[n−1] and the scan signal of nth stage S[n] are at the high potential VGH, and the enable signal EM is at the low potential VGL.

Furthermore, as the light emitting device operates, a current through the light emitting device is calculated from a hole mobility of the first thin film transistor T1, a capacitance of a gate insulating layer per unit area in the first thin film transistor T1, a channel width and a channel length of the first thin film transistor T1, and a voltage value of the data signal.

The current through the light emitting device is Id, and the Id satisfies:

$$Id = \frac{1}{2}\mu_p C_{ox}\frac{W}{L}(V_{data})^2;$$

μp is the hole mobility of the first thin film transistor T1. Cox is the capacitance of the gate insulating layer per unit area in the first thin film transistor T1. W is the channel width of the first thin film transistor T1, and L is the channel length of the first thin film transistor T1.

In conclusion, in the pixel compensating circuit and the pixel compensating method provided by the present invention, in the first period, the fourth thin film transistor T4 can be controlled to be on, and the stored charge stored in the storage capacitor Cst may be cleared; in the second period, the second thin film transistor T2 and the fifth thin film transistor T5 are controlled to be on, controlling the second thin film transistor T2 to be on may short-circuit the gate and the drain of the first thin film transistor T1, and then the first thin film transistor T1 is equivalent to a diode, and may pull the potential of the gate of the first thin film transistor T1 to Vdd−|Vth1|; the fifth thin film transistor T5 is controlled to be on, and the potential of the second end of the storage capacitor Cst can be pulled to Vdata, and then the voltage drop of the storage capacitor Cst is Vdd−|Vth1|−Vdata; in the third period, the third thin film transistor T3 and the sixth thin film transistor T6 are controlled to be on; as the sixth thin film transistor T6 is turned on, the gate potential of the first thin film transistor T1 can be pulled to Vdd−|Vth1|−Vdata due to the capacitance characteristic of the storage capacitor Cst, and the first thin film transistor T1 can be controlled to turn on; meanwhile, the third thin film transistor T3 is also turned on, the current of the first thin film transistor T1 flows to the light emitting device through the third thin film transistor T3, and the light emitting device is driven to emit light.

Since the threshold voltage of the first thin film transistor T1 is prone to drift, the magnitude of the currents flowing through different light emitting devices are different, thereby causing luminance unevenness when the light emitting device emits light. In the pixel compensating circuit of the present invention, the threshold voltage of the first thin film transistor T1 can be compensated by the second thin film transistor T2. When the light emitting device emits light, the magnitude of the current flowing through the light emitting device is independent of the threshold voltage of the first thin film transistor T1.

When the voltage of the light emitting device such as an OLED device provided by the pixel compensating circuit is unstable and drifts, the electron and hole transport efficiency (i.e., the channel mobility) of the light emitting device may be affected, thereby affecting the luminous stability of the light emitting device, and affecting the quantum efficiency of the light emitting device. Namely, the threshold voltage of the first thin film transistor T1 will influence the electron and hole transport efficiency in the light emitting device and the quantum efficiency of the light emitting device. Therefore, the present invention reduces the influence of the threshold voltage of the first thin film transistor T1 on the light emitting device. Meanwhile, the influence of factors such as the electron and hole transport efficiency in the light emitting device and the quantum efficiency of the light emitting device is reduced.

Therefore, in the present invention, the influence of the first thin film transistor T1 on the light emitting device can be reduced, so that the brightness of the different light emitting devices when emitting light is uniform. Moreover, the present invention eliminates one thin film transistor or one capacitor in comparison with a pixel compensating circuit of 7T1C or 6T2C, which reduces the design difficulty of the pixel compensating circuit.

The above content with the specific preferred embodiments of the present invention is further made to the detailed description, the specific embodiments of the present invention should not be considered limited to these descriptions.

Those of ordinary skill in the art for the present invention, without departing from the spirit of the present invention, can make various simple deduction or replacement, should be deemed to belong to the scope of the present invention.

What is claimed is:

1. A pixel compensating circuit, comprising:

a first thin film transistor, wherein a source of the first thin film transistor receives a constant direct current voltage signal;

a second thin film transistor, wherein a first end of the second thin film transistor is connected to a gate of the first thin film transistor, and a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, and a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of (n−1)th stage, wherein n is a positive integer;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, and a second end of the fifth thin film transistor receives a data signal, and a third end of the fifth thin film transistor receives the scan signal of nth stage; and a sixth thin film transistor, wherein a first end of the sixth thin film transistor is connected to the second end of the storage capacitor, and a second end of the sixth thin film transistor is connected to the common ground, and a third end of the sixth thin film transistor receives the enable signal, wherein on and off of the second thin film transistor and the fifth thin film transistor is controlled with the scan signal of nth stage, on and off of fourth thin film transistor is controlled with the scan signal of (n−1)th stage, and on and off of the third thin film transistor and the sixth thin film transistor is controlled with the enable signal.

2. The pixel compensating circuit according to claim 1, wherein the first thin film transistor, the second thin film transistor, the third thin film transistor, the fourth thin film transistor, the fifth thin film transistor and the sixth thin film transistor are all P-type thin film transistors.

3. The pixel compensating circuit according to claim 2, wherein the light emitting device is an organic light emitting diode device.

4. The pixel compensating circuit according to claim 3, wherein as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

5. A pixel compensating method, applied in a pixel compensating circuit, wherein the pixel compensating circuit comprises:

a first thin film transistor, wherein a source of the first thin film transistor receives a constant direct current voltage signal;

a second thin film transistor, wherein a first end of the second thin film transistor is connected to a gate of the first thin film transistor, a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of (n−1)th stage, wherein n is a positive integer;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, a second end of the fifth thin film transistor receives a data signal, and a third end of the fifth thin film transistor receives the scan signal of nth stage; and a sixth thin film transistor, wherein a first end of the sixth thin film transistor is connected to the second end of the storage capacitor, a second end of the sixth thin film transistor is connected to the common ground, and a third end of the sixth thin film transistor receives the enable signal, the pixel compensating method comprising:

turning on the fourth thin film transistor to clear a charge of the storage capacitor;

turning on the second thin film transistor to pull a gate potential of the first thin film transistor and the first end of the storage capacitor to a first potential value, and turning on the fifth thin film transistor to pull a potential of the second end of the storage capacitor to a second potential value, wherein the first potential value is Vdd−|Vth1|, the second potential value is Vdata, Vdd is a voltage value of the constant direct current voltage signal received by the source of the first thin film transistor, Vth1 is a threshold voltage of the first thin film transistor, and Vdata is a voltage value of the data signal received by the fifth thin film transistor; and turning on the sixth thin film transistor to pull a potential of the gate of the first thin film transistor to a third potential value to control the first thin film transistor to be on, and turning on the third thin film transistor to drive the light emitting device to emit light, wherein the third potential value is Vdd−|Vth1|−Vdata.

6. The pixel compensating method according to claim 5, wherein the fourth thin film transistor is turned on with the scan signal of (n−1)th stage, the second thin film transistor and the fifth thin film transistor are turned on with the scan signal of nth stage, and the third thin film transistor and the sixth thin film transistor are turned on with the enable signal.

7. The pixel compensating method according to claim 6, wherein: as the fourth thin film transistor is turned on with the scan signal of (n−1)th stage, the scan signal of (n−1)th stage is a low potential signal; and as the second thin film transistor and the fifth thin film transistor are turned on with the scan signal of nth stage, the scan signal of nth stage is a low potential signal;

as the third thin film transistor and the sixth thin film transistor are turned on with the enable signal, the enable signal is a low potential signal.

8. The pixel compensating method according to claim 5, wherein as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

9. A pixel compensating method, applied in a pixel compensating circuit, wherein the pixel compensating circuit comprises:

a first thin film transistor, wherein a source of the first thin film transistor receives a constant direct current voltage signal;

a second thin film transistor, wherein a first end of the second thin film transistor is connected to a gate of the first thin film transistor, a second end of the second thin film transistor is connected to a drain of the first thin film transistor, and a third end of the second thin film transistor receives a scan signal of nth stage;

a third thin film transistor, wherein a first end of the third thin film transistor is connected to a drain of the first thin film transistor, a second end of the third thin film transistor is connected to a common ground through a light emitting device, and a third end of the third thin film transistor receives an enable signal;

a fourth thin film transistor, wherein a first end and a third end of the fourth thin film transistor receives a scan signal of (n−1)th stage, wherein n is a positive integer;

a storage capacitor, wherein a first end of the storage capacitor is connected to the gate of the first thin film transistor and to the second end of the fourth thin film transistor;

a fifth thin film transistor, wherein a first end of the fifth thin film transistor is connected to a second end of the storage capacitor, a second end of the fifth thin film transistor receives a data signal, and a third end of the fifth thin film transistor receives the scan signal of nth stage; and a sixth thin film transistor, wherein a first end of the sixth thin film transistor is connected to the second end of the storage capacitor, a second end of the sixth thin film transistor is connected to the common ground, and a third end of the sixth thin film transistor receives the enable signal, the pixel compensating method comprising:

turning on the fourth thin film transistor to clear a charge of the storage capacitor;

turning on the second thin film transistor to pull a gate potential of the first thin film transistor and the first end of the storage capacitor to a first potential value, and turning on the fifth thin film transistor to pull a potential of the second end of the storage capacitor to a second potential value, wherein the first potential value is Vdd−|Vth1|, the second potential value is Vdata, Vdd is a voltage value of the constant direct current voltage signal received by the source of the first thin film transistor, Vth1 is a threshold voltage of the first thin film transistor, and Vdata is a voltage value of the data signal received by the fifth thin film transistor; and turning on the sixth thin film transistor to pull a potential of the gate of the first thin film transistor to a third potential value to control the first thin film transistor to be on, and turning on the third thin film transistor to drive the light emitting device to emit light, wherein the third potential value is Vdd−|Vth1|−Vdata, wherein the fourth thin film transistor is turned on with the scan signal of (n−1)the stage, the second thin film transistor and the fifth thin film transistor are turned on with the scan signal of nth stage, and the third thin film transistor and the sixth thin film transistor are turned on with the enable signal, and wherein: as the light emitting device operates, a current through the light emitting device is calculated from a hole mobility of the first thin film transistor, a capacitance of a gate insulating layer per unit area in the first thin film transistor, a channel width and a channel length of the first thin film transistor, and a voltage value of the data signal.

10. The pixel compensating method according to claim 9, wherein: as the fourth thin film transistor is turned on with the scan signal of (n−1)th stage, the scan signal of (n−1)th stage is a low potential signal; and as the second thin film transistor and the fifth thin film transistor are turned on with the scan signal of nth stage, the scan signal of nth stage is a low potential signal;

as the third thin film transistor and the sixth thin film transistor are turned on with the enable signal, the enable signal is a low potential signal.

* * * * *